US007964815B2

(12) United States Patent
Asada

(10) Patent No.: US 7,964,815 B2
(45) Date of Patent: Jun. 21, 2011

(54) PUSH-BUTTON SWITCH

(75) Inventor: Makoto Asada, Osaka (JP)

(73) Assignee: Hosiden Corporation, Yao-Shi, Osaka (JP)

( * ) Notice: Subject to any disclaimer, the term of this patent is extended or adjusted under 35 U.S.C. 154(b) by 378 days.

(21) Appl. No.: 12/216,976

(22) Filed: Jul. 14, 2008

(65) Prior Publication Data

US 2009/0014308 A1 Jan. 15, 2009

(30) Foreign Application Priority Data

Jul. 13, 2007 (JP) ..... 2007-184077

(51) Int. Cl.
*H01H 3/20* (2006.01)

(52) U.S. Cl. ..... 200/406; 200/341

(58) Field of Classification Search ..... 200/331
See application file for complete search history.

(56) References Cited

U.S. PATENT DOCUMENTS

| | | | | |
|---|---|---|---|---|
| 5,660,272 | A * | 8/1997 | Janniere et al. | 200/517 |
| 6,018,132 | A * | 1/2000 | Chen | 200/406 |
| 6,495,783 | B2 * | 12/2002 | Rochon et al. | 200/406 |
| 6,756,554 | B1 * | 6/2004 | Hu | 200/406 |
| 7,449,654 | B2 * | 11/2008 | Tsuduki | 200/406 |
| 7,547,858 | B2 * | 6/2009 | Nagata | 200/520 |
| 7,741,573 | B2 * | 6/2010 | Masuda et al. | 200/406 |
| 2005/0029084 | A1 | 2/2005 | Watanabe et al. | |
| 2006/0037851 | A1 * | 2/2006 | Hu et al. | 200/406 |
| 2009/0200147 | A1 * | 8/2009 | Watanabe | 200/406 |

FOREIGN PATENT DOCUMENTS

| | | | |
|---|---|---|---|
| EP | 1 113 472 | A1 | 7/2001 |
| JP | 5001 125 | U | 1/1993 |
| JP | 2001 202850 | A | 7/2001 |
| JP | 2004 303716 | A | 10/2004 |
| JP | 2006 202527 | A | 8/2006 |
| JP | 2006 244977 | | 9/2006 |

* cited by examiner

*Primary Examiner* — Renee Luebke
*Assistant Examiner* — Lisa Klaus
(74) *Attorney, Agent, or Firm* — Bacon & Thomas, PLLC

(57) ABSTRACT

In a lateral pushing type push-button switch, a pair of guiding portions against which an actuating portion that is projected from a pressing portion of an operating member into a housing is buttable are disposed in a cover which is attached to an upper portion of the housing. The switch has a second actuating member which is formed in continuously with a peripheral portion that is accommodated in a peripheral side portion of the housing, and which is projected into the housing to be opposed to the actuating portion. When the operating member is pressed in a lateral direction, the actuating portion and the second actuating member are downward displaced to depress movable contacts to be contacted with stationary contacts.

18 Claims, 12 Drawing Sheets

PUSH-BUTTON SWITCH

BACKGROUND OF THE INVENTION

1. Field of the Invention

The present invention relates to a lateral pushing type push-button switch which is to be used in a small electronic apparatus such as a portable telephone, a digital camera, a PDA, or a portable audio player.

2. Description of the Prior Art

Conventionally, a lateral pushing type push-button switch is known in which a pressing force in a lateral direction (horizontal direction) is converted to a longitudinal direction (vertical direction) (for example, see Japanese Patent Application Laying-Open No. 2006-244977). FIGS. 9 to 12 show such a conventional push-button switch.

In FIGS. 9 to 12, the reference numeral 1 denotes a housing which is made of an insulating material such as a synthetic resin, and which is formed into a box-like shape having an accommodating portion 1*a* and an opened upper face. In the inner bottom of the accommodating portion 1*a*, a pair of stationary contacts 2*a*, 2*b* which are configured by a conductive metal plate are integrally embedded by a method such as insert molding so that the contacts are partly exposed from the inner bottom face. External terminal 3*a*, 3*b* which are led out from the pair of stationary contacts 2*a*, 2*b* are projectingly formed in lower portions of paired opposed side faces of the housing 1, respectively. A window portion 1*b* communicating with the accommodating portion 1*a* is disposed in another side face of the housing 1. Engaging projections 1*c* which are outward projected are formed in the four corner of the housing 1, respectively.

A movable contact 4 which is configured by a conductive thin metal plate, and which is curved in a dome-like shape so as to be invertible is placed above the paired stationary contacts 2*a*, 2*b* in the accommodating portion 1*a*. The movable contact 4 is placed in a state where the lower face of a dome top portion is opposed to the one stationary contact 2*a* exposed from the inner bottom face with maintaining a predetermined gap therebetween, and an edge portion of the outer periphery of the dome is contacted with the other stationary contact 2*b* exposed from the inner bottom face of the accommodating portion 1*a* (this contacted state is not shown in FIG. 9).

A dust-proof sheet 5 which is configured by an insulative resin sheet member such as polyamide resin is disposed on the upper face side of the movable contact 4. A peripheral edge portion of the dust-proof sheet 5 is placed on the upper face of the accommodating portion 1*a* of the housing 1 and fixed by an adhesive agent or the like so as to cover the opening of the accommodating portion 1*a*, thereby preventing dust, a foreign material, and the like from entering the contact portions in the accommodating portion 1*a*.

The reference numeral 6 denotes an operating member made of an insulating material such as a synthetic resin, and having: a pressing portion 6*a* which is projected from the window portion 1*b* of the housing 1; an actuating portion 6*b* which is projected from the pressing portion 6*a* into the accommodating portion 1*a*; and a slide portion 6*d* which is formed in continuous with the pressing portion 6*a* so as to surround the both sides and rear of the actuating portion 6*b* through an opening 6*c* that is disposed in the periphery of the actuating portion 6*b*. The operating member 6 is placed on the upper face side of the dust-proof sheet 5 placed in the accommodating portion 1*a*. The pressing portion 6*a* is projected from the window portion 1*b* of the housing 1. A butting portion 6*e* which is a free end of the actuating portion 6*b* is opposed to the upper face of the dome top portion of the movable contact 4 across the dust-proof sheet 5. The slide portion 6*d* is slidably accommodated in the accommodating portion 1*a*.

The reference numeral 7 denotes a cover which is formed by stamping and bending a metal plate, and which has: an upper plate 7*a* that is attached to an upper portion of the housing 1, and that is formed in a flat plate-like shape so as to cover the accommodating portion 1*a*; and four attachment legs that are bent substantially perpendicularly from four edges of the upper plate 7*a* to hang in an L-shape, respectively. Engaging pieces are disposed at the tip ends of the attachment legs, and engaged with the engaging projections 1*c* disposed in the four corners of the housing 1, respectively, whereby the cover 7 is attached to the upper portion of the housing 1.

A guiding portion is formed in a substantially middle of the upper plate 7*a*. The guiding portion is bent into the accommodating portion 1*a* of the housing 1, and butts against the butting portion 6*e* of the actuating portion 6*b* of the operating member 6 to guide the actuating portion 6*b* in the pressing direction of the movable contact 4. The guiding portion is configured by: an inclined portion 7*d* formed by a slope of about 45 degrees which is formed by bending the plate face of the upper plate 7*a* into the accommodating portion 1*a* of the housing 1 along the pressing direction of the operating member 6; and a pair of connecting portions 7*e* which have a substantially triangular shape, which are disposed in continuous to the both sides of the inclined portion 7*d*, and which are connected to the upper plate 7*a*. When the cover 7 is attached to the upper portion of the housing 1, the inclined portion 7*d* and the connecting portions 7*e* are positioned in an opening 6*c* disposed in the slide portion 6*d* of the operating member 6. At this time, the inclined portion 7*d* is opposed to the butting portion 6*e* (free end) of the actuating portion 6*b* of the operating member 6. Rear end sides of the inclined portion 7*d* and connecting portions 7*e* which are bent into the opening 6*c* are cut away, to prevent the inclined portion 7*d* and the connecting portions 7*e* from butting against the rear end of the opening 6*c* of the slide portion 6*d* when the slide portion 6*d* slides in the accommodating portion 1*a*.

The guiding portion is formed in the cover 7 in the following manner. First, a cutout 7*f* which is slightly thin is formed by press or the like at a position of the upper plate 7*a* of the cover 7 which will be formed as the rear end of the guiding portion. Next, a portion in front of the cutout 7*f* is downward bent at about 45 degrees by press or the like, thereby forming the inclined portion 7*d*, and the pair of connecting portions 7*e* which are continuous to the sides of the inclined portion 7*d*, and which have a substantially triangular shape.

In the conventional push-button switch having the above-described configuration, in an initial state shown in FIG. 9, the butting portion 6*e* (free end) of the actuating portion 6*b* of the operating member 6 butts against the upper face of the dome top portion of the movable contact 4 through the dust-proof sheet 5, and the pressing portion 6*a* is urged in the leftward direction in the figure (opposite to the pressing direction of the pressing portion 6*a*) to be outward projected, by a synergistic action between the upward elastic urging force of the movable contact 4, and the slope of the inclined portion 7*d* of the cover 7. At this time, in the movable contact 4, the edge portion of the outer periphery is contacted with the stationary contact 2*b*, but the lower face of the dome top portion is separated from the stationary contact 2*a*, so that the switch is in the OFF state.

When, in this state, the pressing portion 6*a* is pressed in the rightward direction in the figure, as shown in FIG. 12, the butting portion 6*e* (free end) of the actuating portion 6*b* is guided along the inclined portion 7*d* in the downward direction in the figure (the direction perpendicular to the pressing direction of the pressing portion 6*a*), and presses the upper face of the dome top portion of the movable contact 4 through the dust-proof sheet 5, whereby the movable contact 4 is downward inverted. Then, the lower face of the dome top portion of the movable contact 4 is contacted with the stationary contact 2*a*, and the stationary contacts 2*a*, 2*b* are electrically connected with each other, so that the switch is in the ON state.

When the pressing to the pressing portion 6*a* is released in this state, the movable contact 4 is upward inverted and returned by an inversion returning force of the movable contact 4 itself, and the switch is in the OFF state. By the urging force exerted at this time, the butting portion 6*e* of the actuating portion 6*b* is oppositely urged along the inclined portion 7*d* in the leftward direction in the figure (the direction opposite to the pressing direction of the pressing portion 6*a*), and the pressing portion 6*a* is outward projected to be returned to the initial state.

SUMMARY OF THE INVENTION

As described above, a conventional lateral pushing type push-button switch is of the one-step operation type. Recently, in addition to miniaturization and thinning, multi-functionalization of a small electronic apparatus is being advanced. Under this situation, a switch of the two-step operation type is strongly requested. In a conventional lateral pushing type push-button switch, when movable contacts are vertically disposed in two stages, however, the height of the inclined portion 7*d* of the cover 7 must be increased, thereby causing a problem in that the total height of the push-button switch becomes large.

The invention has been conducted in view of the above-discussed problems. It is an object of the invention to provide a lateral pushing type push-button switch which is small and thin, and in which a movable-contact depressing stroke that is longer than that in the prior art can be ensured without increasing the height of the switch.

In order to attain the object, the lateral pushing type push switch of the invention is a switch in which the switch comprises: a housing having an accommodating portion; a stationary contact disposed in a bottom portion of the accommodating portion; a movable contact disposed above the stationary contact; an operating member which is slidably accommodated in the accommodating portion, and which has: a pressing portion that is outward projected from a side portion of the housing; and an actuating portion that has a cantilever structure, and that is projected from the pressing portion into the accommodating portion; and a cover which is configured by a metal plate, which is attached to an upper portion of the housing to cover the accommodating portion, and which has a guiding portion against which a tip end side of the actuating portion is buttable, and, when the pressing portion is pressed in a lateral direction, the tip end side of the actuating portion is caused to butt against the guiding portion to be guided toward the movable contact which is on a lower side, thereby contacting the movable contact with the stationary contact, wherein the switch further comprises: a second actuating member which has a peripheral portion that is positioned and fixed to be accommodated in a peripheral side portion of the accommodating portion, which is formed in continuously with the peripheral portion and projected into the accommodating portion to be opposed to the actuating portion, and which has a cantilever structure; a pair of the guiding portions which are disposed on both sides of the tip end side of the second actuating portion; first inclined portions which are disposed on the guiding portions, respectively, and which are inclined with respect to a pressing direction of the pressing portion; a second inclined portion which is disposed on an upper portion of a tip end side of the actuating portion, and which is opposed to the first inclined portions; a third inclined portion which is disposed on a lower portion of the tip end side of the actuating portion, and which extends in a direction intersecting with the first and second inclined portions that are opposed to each other; a fourth inclined portion which is disposed on an upper portion of a tip end side of the second actuating member, and which is opposed to the third inclined portion; and a projection which is disposed on a lower portion to the tip end side of the second actuating member, and which is opposed to the movable contact, and, when the pressing portion is pressed in the lateral direction, while the tip end side of the actuating portion causes the second inclined portion to butt against the first inclined portion and is guided toward the movable contact which is on the lower side, the tip end side of the actuating portion causes the second inclined portion to butt against the third inclined portion to displace the tip end side of the second actuating member toward the movable contact which is on the lower side, and the projection to butt against the movable contact to depress the movable contact, whereby the movable contact is contacted with the stationary contact.

According to the configuration, a movable-contact depressing stroke that is longer than that in the prior art can be ensured with the same press stroke as the prior art. Moreover, the second actuating member can be disposed at the level where the actuating portion of the operating member and the guiding portions of the cover are disposed, and hence the total height of the push-button switch is not increased.

In the push-button switch of the invention, preferably, a peripheral portion of the second actuating member is formed into a U-like shape which surrounds a basal end side and both sides of the second actuating member, a middle portion of the peripheral portion from which the second actuating member is projected is formed to be thinner than both end portions, and, while the middle portion is twistingly deformed, the tip end side of the second actuating member is displaced toward the movable contact which is on the lower side.

According to the configuration, a stress produced in the second actuating member can be reduced. Even when the displacement amount of the second actuating member is larger than that of the actuating portion, therefore, a durability equivalent to the actuating portion can be ensured by the second actuating member having a size which is approximately equal to the actuating portion, and hence the life of the push-button switch can be prevented from being shortened, without increasing the total size of the push-button switch.

In the push-button switch of the invention, preferably, the operating member comprises, on both sides of the actuating portion, a pair of sliding portions which are projected from the pressing portion to the peripheral side portion of the accommodating portion, a peripheral portion of the second actuating member is formed into a U-like shape which surrounds a basal end side and both sides of the second actuating member, and guide portions which slidably support the sliding portions are disposed in both end portions of the peripheral portion of the second actuating member.

According to the configuration, the positional accuracy between the actuating portion and the second actuating member can be improved, and hence a stable movable-contact depressing stroke can be obtained.

In the push-button switch of the invention, preferably, a surface of one of the third and fourth inclined portions is formed as a flat face, and a surface of another portion is formed as a convex curved face.

According to the configuration, the third and fourth inclined portions slide with each other in line contact, and abrasions of the third and fourth inclined portions can be suppressed. Therefore, a stable movable-contact depressing stroke can be obtained.

In the push-button switch of the invention, preferably, a surface of the projection is configured by a part of a convex spherical face.

According to the configuration, the projection can be in point contact with the movable contact, and an abrasion of the projection can be suppressed. Therefore, a stable movable-contact depressing stroke can be obtained. In the case where the movable contact is configured by an invertible dome-like metal plate, furthermore, the center of the plate can be accurately depressed, and hence it is possible to obtain an excellent operation sense.

In the push-button switch of the invention, preferably, the cover is attached to an upper portion of the housing, and comprises an upper plate which is formed in a flat plate-like shape so as to cover the accommodating portion, each of the guiding portions is formed by a pressing process in which the upper plate is partly formed into a V-like three-dimensional shape where an outer face is concave, an inner face is convex, and both ends are closed, and the first inclined portion is formed by one inclined linear portion of the V-like shape.

According to the configuration, the first inclined portion can be disposed without forming a hole in the upper plate of the cover. Therefore, a dust-proof sheet, which is used in a conventional push-button switch, is not necessary, the total height of the push-button switch can be reduced, and reductions of the number of parts of the push-button switch, assembly steps, and the production cost can be reduced.

In the push-button switch of the invention, preferably, the movable contact is configured by an invertible dome-like metal plate, and the projection of the second actuating member is opposed to a center portion of the movable contact.

According to the configuration, the center of the movable contact can be accurately depressed, and hence it is possible to obtain an excellent operation sense.

In the push-button switch of the invention, preferably, the movable contact is configured by an invertible dome-like metal plate, the movable contact is disposed in two upper and lower stages, different first, second, and third stationary contacts are disposed at three places of a bottom side of a peripheral portion of an upper movable contact, and bottom sides of peripheral and center portions of a lower movable contact, the upper movable contact is always contacted with the first stationary contact, the lower movable contact is always contacted with the second stationary contact, when the upper movable contact is depressed, the upper movable contact is downward inverted to be contacted with the lower movable contact, and, when the upper movable contact is further depressed, the lower movable contact is depressed to be inverted to be contacted with the third stationary terminal.

According to the configuration, a lateral pushing type push-button switch, which is conventionally configured as a one-step operation type, can be configured as a two-step operation type without increasing the height, and while ensuring a movable-contact depressing stroke that is longer than that in the prior art.

In this case, preferably, the lower movable contact comprises a bent portion which is pressed by a part of the peripheral portion of the second actuating member, to prevent the lower movable contact from rising.

According to the configuration, in a lateral pushing type push-button switch of the two-step operation type, the lower movable contact can be prevented from rising. Therefore, the insulation distance between the upper and lower movable contacts can be maintained, and an excellent operation sense of the second step can be obtained.

As described above, according to the invention, it is possible to provide a lateral pushing type push-button switch which is small and thin, and in which a movable-contact depressing stroke that is longer than that in the prior art can be ensured without increasing the height of the switch. Furthermore, it is possible to provide a small and thin lateral pushing type push-button switch of the two-step operation type.

BRIEF DESCRIPTION OF THE DRAWINGS

FIG. 10 is a plan view showing the conventional push-button switch.

FIG. 11 is a plan view showing a state where a cover of the conventional push-button switch is removed away.

DESCRIPTION OF REFERENCE NUMERALS

1 housing
1*a* accommodating portion
2*a* common contact (stationary contact)
3*a* first selection contact (stationary contact)
4*a* second selection contact (stationary contact)
5 upper movable contact (movable contact)
6 lower movable contact (movable contact)
6*a* bent portion
7 cover
7*a* upper plate
8 guiding portion
8*a* first inclined portion
9 operating member
9*a* pressing portion
9*b* actuating portion
9*c* sliding portion
9*d* second inclined portion

9*e* third inclined portion
10 second actuating member
10*a* peripheral portion
10*b* coupling plate (middle portion of peripheral portion)
10*c* guide portion (both end portions of peripheral portion)
10*d* fourth inclined portion
10*e* projection

DETAILED DESCRIPTION OF THE PREFERRED EMBODIMENT

Figure 2:
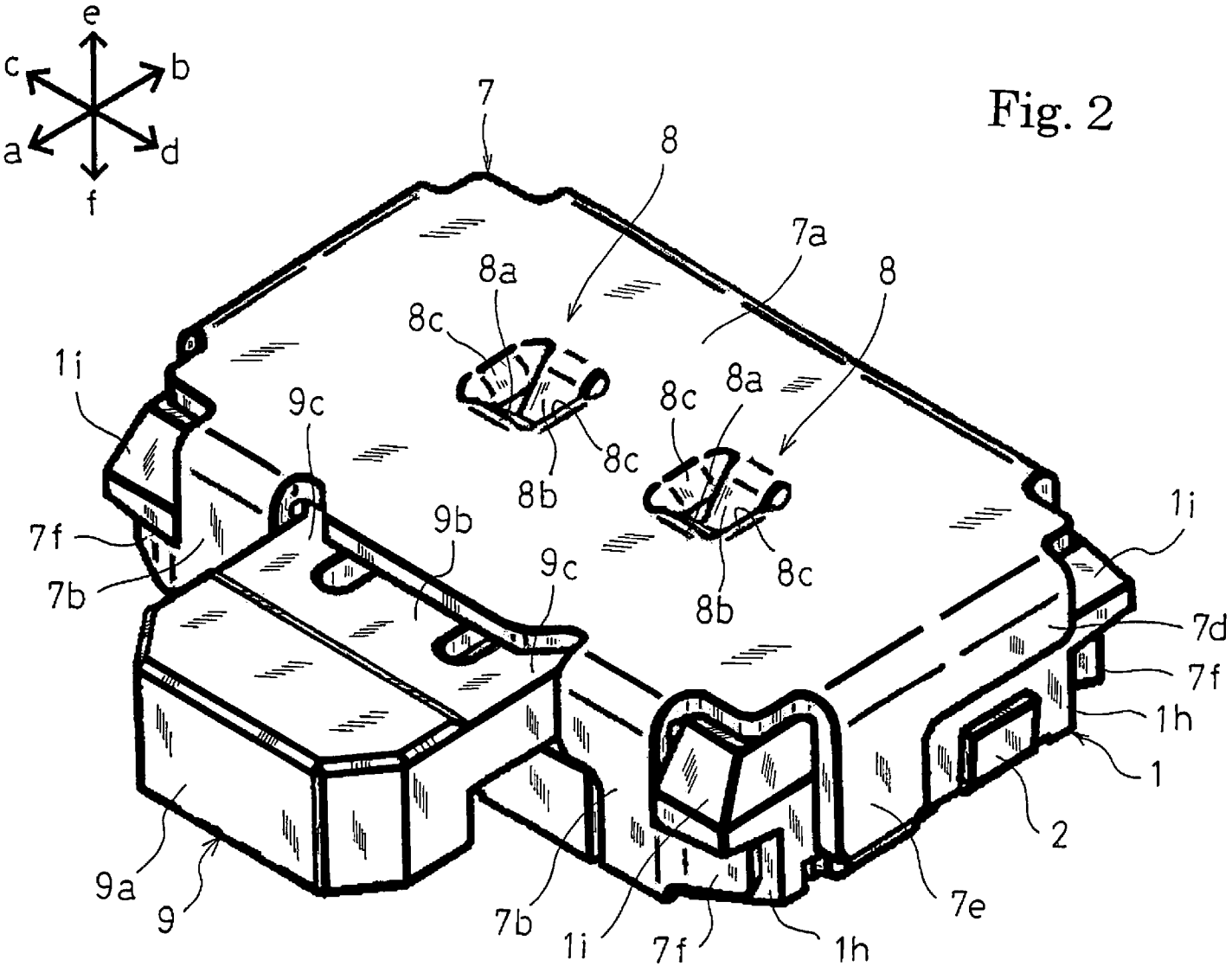
FIG. 2 is a perspective view showing the appearance of the push-button switch of the embodiment of the invention.
Figure 3:
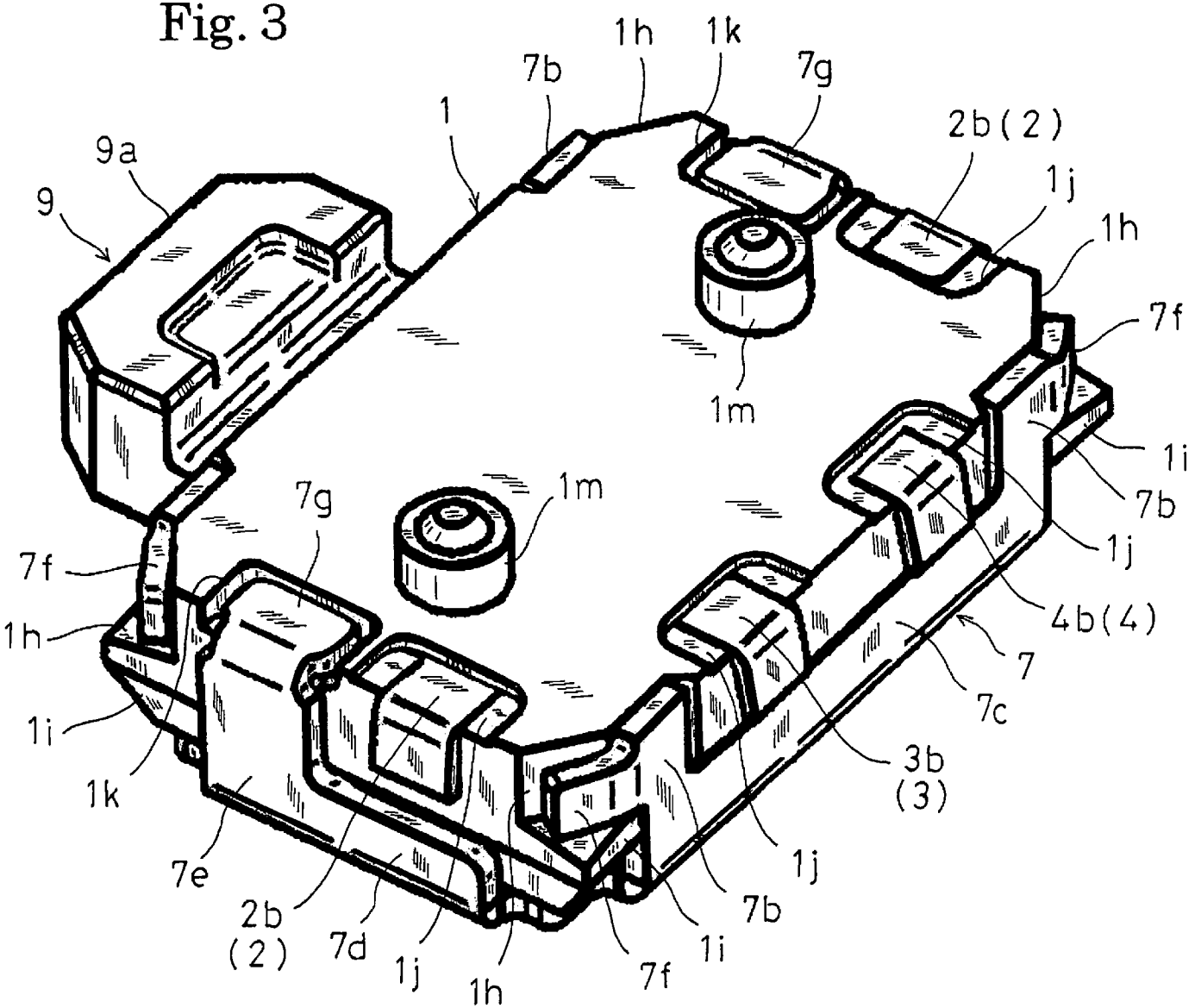
FIG. 3 is a perspective view showing the appearance in a state where the push-button switch of the embodiment of the invention is turned upside down.

Hereinafter, an embodiment of the invention will be described with reference to the accompanying drawings. In the following description, it is assumed that the direction of the arrows a-b in FIG. 2 is the anteroposterior direction of a push-button switch, that of the arrows c-d is the lateral direction of the push-button switch, and that of the arrows e-f is the vertical direction of the push-button switch.

In FIGS. 1 to 6, the reference numeral 1 denotes a housing which is made an insulating material such as a synthetic resin, and which is formed into a box-like shape having an accommodating portion 1*a* and an opened upper face. In the inner bottom face 1*b* of the housing 1, shallow low upper-movable contact supporting recesses 1*c* which are lowered one step from the inner bottom face 1*b* are disposed in the four corners, respectively. Lower-movable contact supporting recesses 1*d* which are deeper and substantially circular are disposed inside the respective upper-movable contact supporting recesses 1*c*. Right and left bent portion accommodating portions 1*e* which are projected between front and rear pairs of the upper-movable contact supporting recesses 1*c* are disposed in the peripheries of the lower-movable contact supporting recesses 1*d*.

Front and rear cutouts 1*f*, 1*g* are disposed in upper portions of the front and rear sidewalls of the housing 1. Engaging recesses 1*h* are disposed in the four corner of the housing 1, and inclined guide portions 1*i* which are gradually ally downward expanded to the outside are disposed above the engaging recesses 1*h*, respectively. Plural shallow external connecting terminal recesses 1*j* are disposed in a peripheral portion of the outer bottom face of the housing 1, and right and left grounding terminal recesses 1*k* which are slightly deeper than the external connecting terminal recesses 1*j* are disposed adjacent to the right and left external connecting terminal recesses 1*j*. Right and left positioning pins 1*m* for mounting are vertically projected inside the external connecting terminal recesses 1*j*.

The housing 1 is molded by insert molding integrally with first, second, and third stationary terminals 2, 3, 4. The first, second, and third stationary terminals 2, 3, 4 are formed by stamping and bending a highly conductive thin metal plate, and embedded in an insulated state in the bottom of the housing 1. In the first stationary terminal 2, its parts are exposed substantially flushly from the upper-movable contact supporting recesses 1*c*, to form a common contact 2*a* serving as a first stationary contact. In the second stationary terminal 3, its parts are exposed substantially flushly from the peripheries of the lower-movable contact supporting recesses 1*d*, to form a first selection contact 3*a* serving as a second stationary contact. In the third stationary terminal 4, its parts are exposed substantially flushly from the center portion of the lower-movable contact supporting recesses 1*d*, to form a second selection contact 4*a* serving as a third stationary contact. In the first, second, and third stationary terminals 2, 3, 4, their other parts are exposed substantially flushly from the respective predetermined external connecting terminal recesses 1*j*, to form a first external connecting terminal 2*a* which is electrically conductive with the common contact 2*b*, a second external connecting terminal 3*b* which is electrically conductive with the first selection contact 3*a*, and a third external connecting terminal 4*b* which is electrically conductive with the second selection contact 4*a*, respectively.

Figure 1:
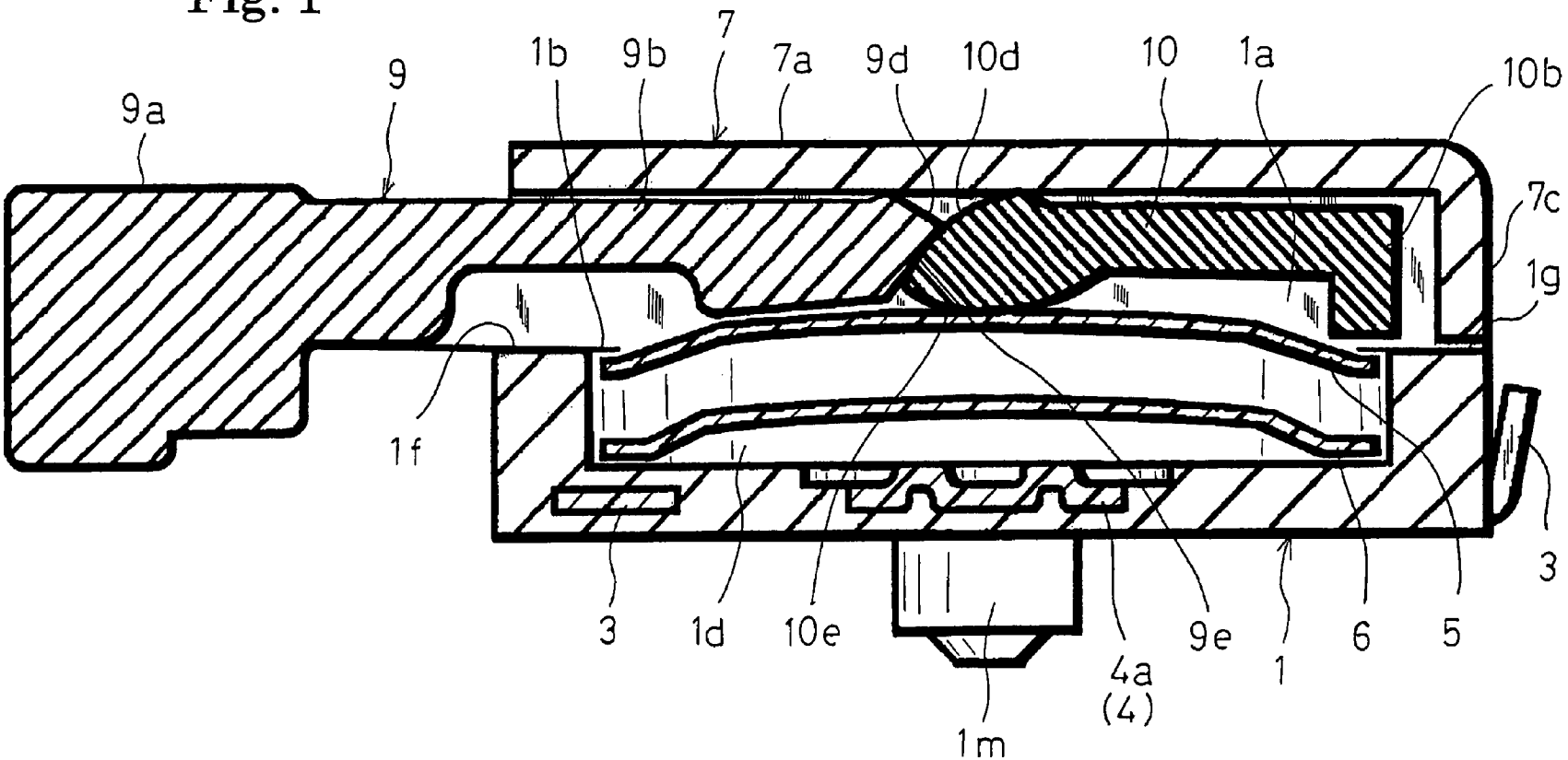
FIG. 1 is a section view showing a push-button switch of an embodiment of the invention.
Figure 4:
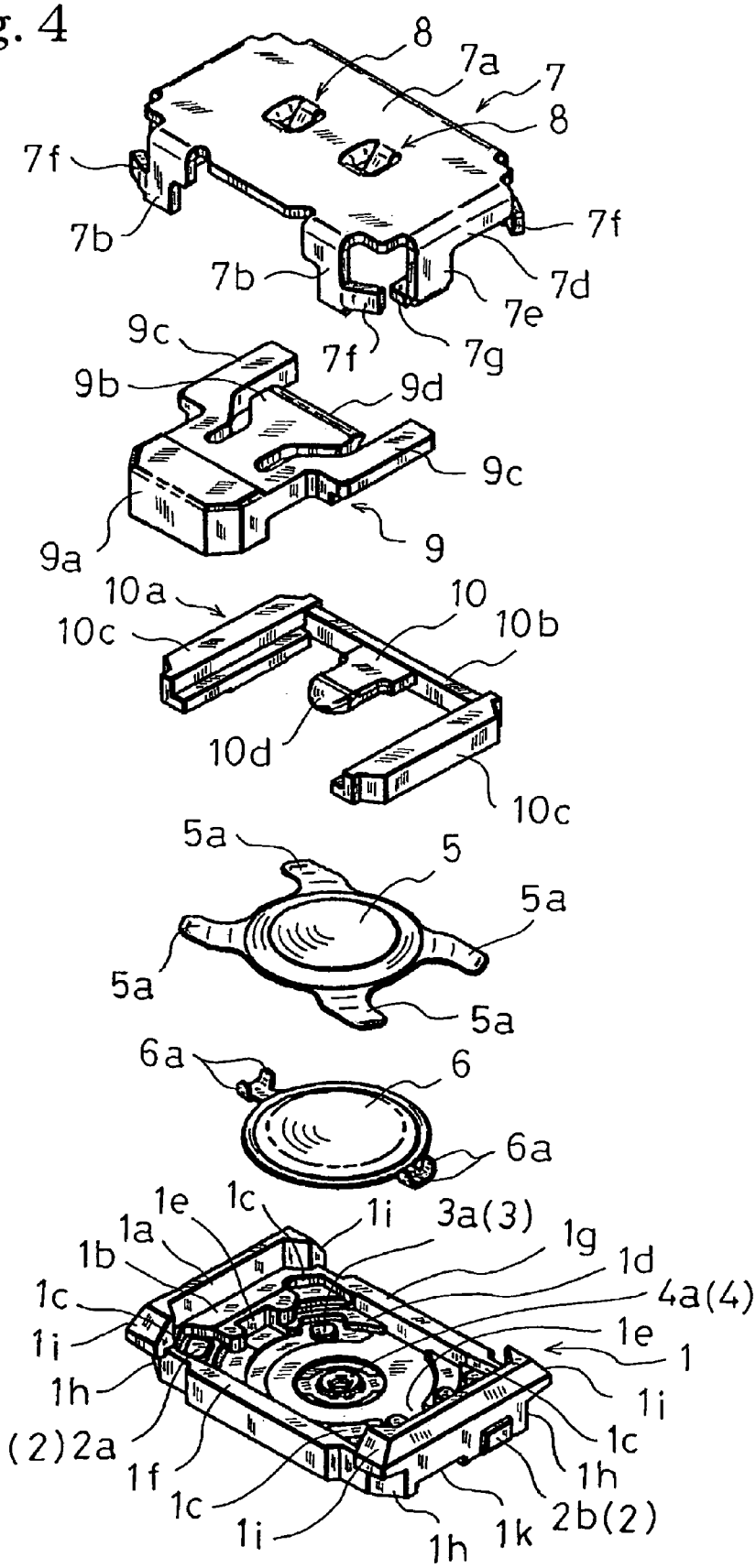
FIG. 4 is an exploded perspective view of the push-button switch of the embodiment of the invention.
Figure 5:
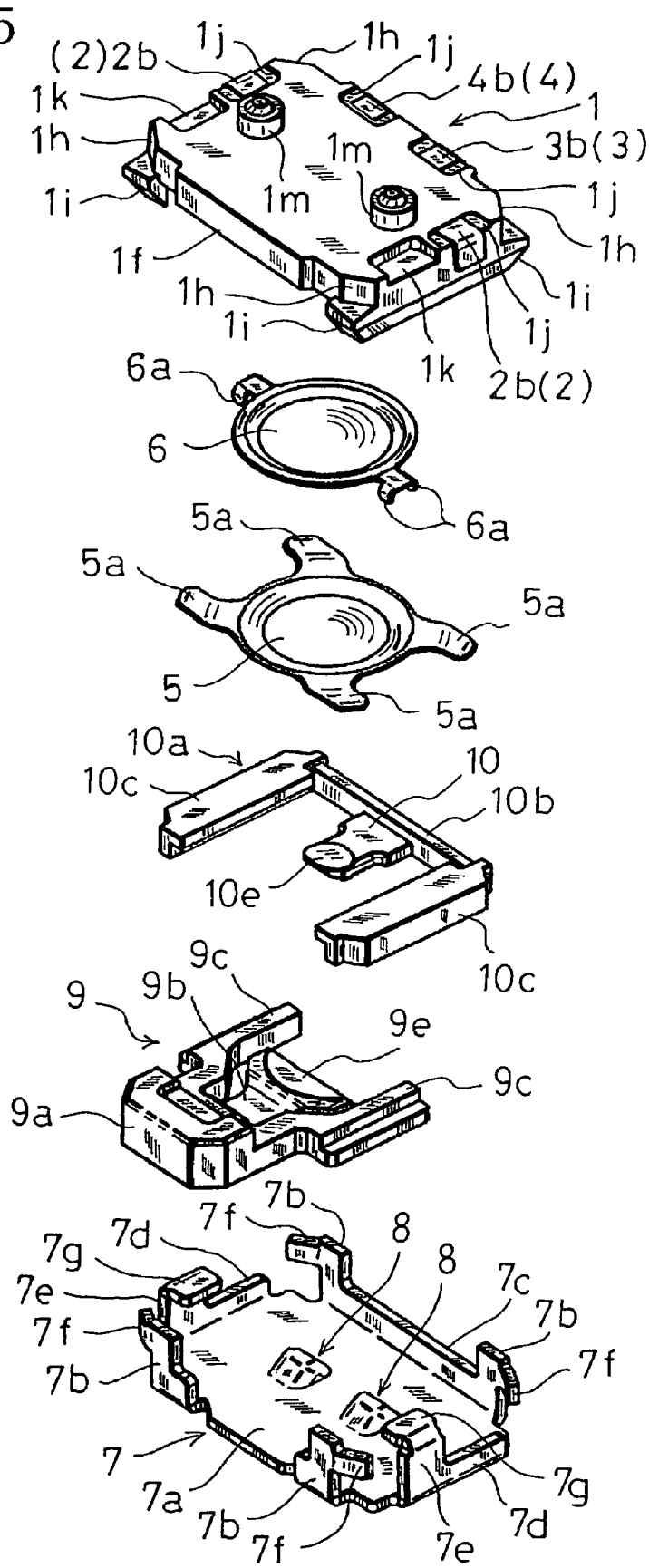
FIG. 5 is an exploded perspective view of a state where the push-button switch of the embodiment of the invention is turned upside down.
Figure 6:
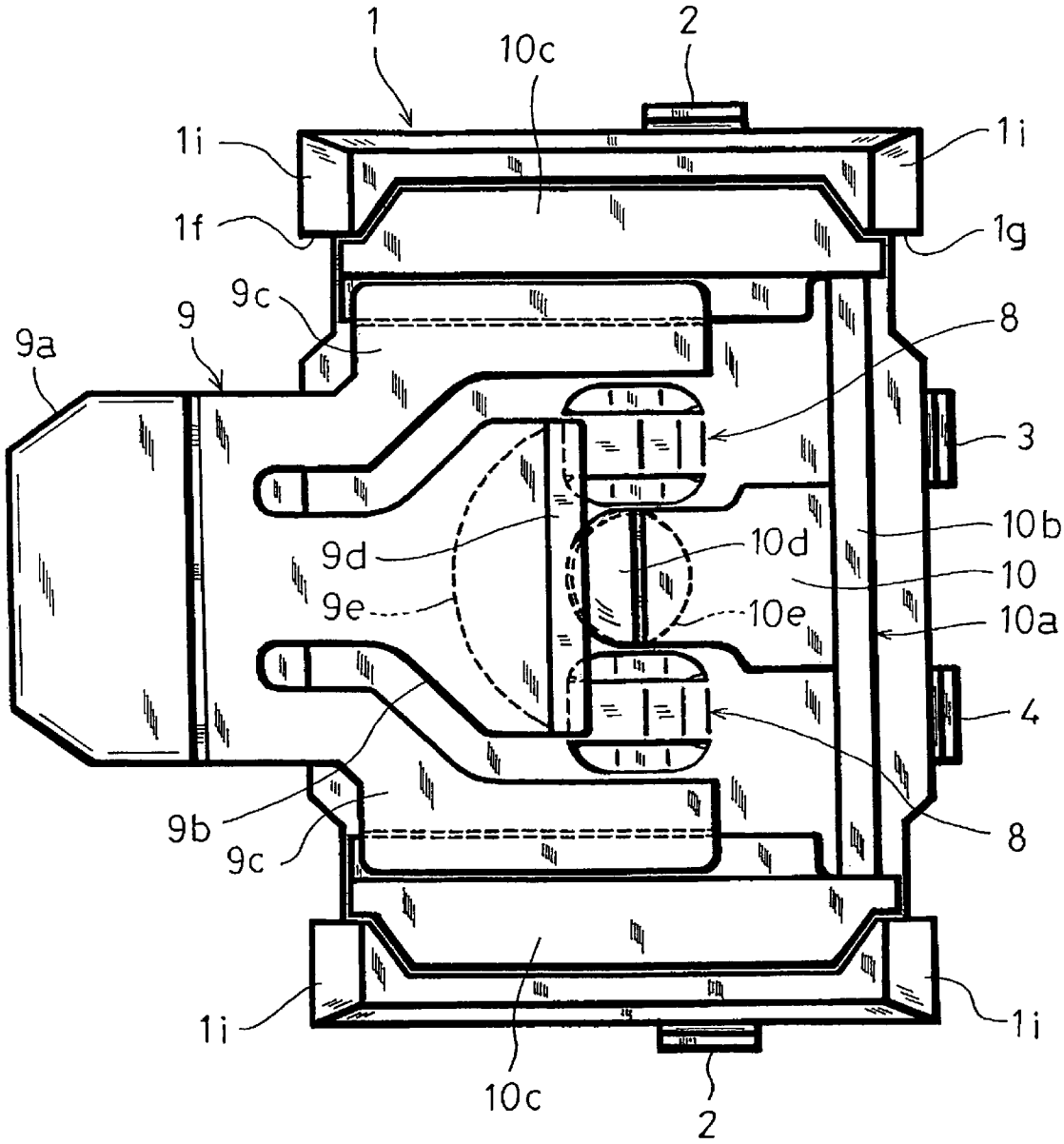
FIG. 6 is a plan view showing a state where a cover of the push-button switch of the embodiment of the invention is removed away.

In FIGS. 1, 4, and 5, the reference numeral 5 denotes an upper movable contact, and 6 denotes a lower movable contact. Each of the upper and lower movable contacts 5, 6 is configured by an invertible dome-like metal plate which is formed by stamping and bending a highly conductive thin metal plate. In the upper movable contact 5, front and rear pairs of leg portions 5*a* which are projected in the lateral direction from the peripheral portion are disposed. In the lower movable contact 6, front and rear bent portions 6*a* which are projected in the lateral direction from the peripheral portion are disposed. Each of the bent portions 6*a* is formed in a U-like shape which is upward opened. The peripheral portion of the upper movable contact 5 is supported by the upper-movable contact supporting recesses 1*c* via the four leg portions 5*a*, and the peripheral portion of the lower movable contact 6 is supported by the peripheral portions of the lower-movable contact supporting recesses 1*d*, so that the upper and lower movable contacts 5, 6 are placed and accommodated in two upper and lower stages in a bottom portion of the accommodating portion 1*a* of the housing 1 while disposing a predetermined gap therebetween. In the placed state, the upper movable contact 5 is always contacted with the common contact 2*a* via the leg portions 5*a*, the peripheral portion of the lower movable contact 6 is always contacted with the first selection contact 3*a*, and the center portion is opposed to the second selection contact 4*a* which is on the lower side, via a predetermined gap. The bent portions 6*a* of the lower movable contact 6 are fitted into the bent portion accommodating portions 1*e*, and upper portions of the bent portions 6*a* are exposed from the inner bottom face 1*b* of the housing 1.

In FIGS. 1 to 5, the reference numeral 7 denotes a cover which is formed by stamping and bending a metal plate. The cover 7 has: an upper plate 7*a* which is attached to an upper portion of the housing 1, and which is formed in a rectangular flat plate-like shape so as to cover the accommodating portion 1*a*; four attachment legs 7*b* which are bent substantially perpendicularly from both end portions of front and rear edges of the upper plate 7*a* to hang in an L-shape; a flat plate-like rear side plate 7*c* which is substantially perpendicularly bent from the rear edge of the upper plate 7*a*, and integrally with the rear right and left attachment legs 7*b*, and which covers the rear cutout 1*g* of the housing 1; right and left side plates 7*d* which are bent substantially perpendicularly from both ends of the front and rear edges of the upper plate 7*a*, and which overlap with upper portions of the right and left side faces of the housing 1; and grounding terminals 7*e* which are further downward extended from front portions of the right and left side plates 7*d*, and in which the tip end sides are downward projected from the outer bottom face of the housing 1. Engaging pieces 7*f* are disposed to the tip ends of the attachment legs 7*b*.

When, in a final stage of assembling the push-button switch, the upper plate 7*a* is attached to the upper portion of the housing 1 to cover the accommodating portion 1*a*, the cover 7 is attached to the housing 1 by outward widening the tip end sides (the engaging pieces 7*f*) of the attachment legs 7*b* while being slidingly contacted with the guide portions 1*i* of the housing 1, then elastically returning the tip end sides to the original shape at the timing when they override the guide portions 1*i*, and engaging the engaging pieces 7*f* with the engaging recesses 1*h* of the housing 1. After the attachment, the tip end sides of the right and left grounding terminals 7*e* which are downward projected from the outer bottom face of the housing 1 are bent substantially perpendicularly toward the inner side, and fitted into the right and left grounding terminal recesses 1*k* of the housing 1, thereby forming right and left grounding soldering portions 7*g* which are exposed substantially flushly from the outer bottom face of the housing 1.

In a middle portion of the upper plate 7*a*, a pair of guiding portions 8 are juxtaposed at right and left axisymmetric positions with setting the lateral center line of the upper plate 7*a* as the symmetric axis. Each of the guiding portions 8 is formed by a pressing process such as the bulging process in which the upper plate 7*a* is partly formed into a V-like three-dimensional shape where the outer face is concave, and the inner face is convex, and the both ends are upward opened at an angle of about 90 degrees in a view from a lateral side which is closed, and configured by: a first inclined portion 8*a* which is formed by one linear portion that is located in the front side of the V-like shape and inclined at about 45 degrees; a rear inclined portion 8*b* which is formed by the other linear portion that is located in the rear side of the V-like shape and inclined at about 45 degrees; and right and left closed end portions 8*c* which are located at lateral ends of the V-like shape, and which have an inverted triangular shape.

In FIGS. 1 to 6, the reference numeral 9 denotes an operating member (push button) which is made of an insulating material such as a synthetic resin, and which has: a pressing portion 9*a* which is outward projected from the front cutout 1*f* of the housing 1; an actuating portion 9*b* having a cantilever structure which is projected from a middle portion of the pressing portion 9*a* into the accommodating portion 1*a*; and right and left sliding portions 9*c* which are on the lateral sides of the actuating portion 9*b*, and which are projected from the right and left end portions of the pressing portion 9*a* into the accommodating portion 1*a*. The operating member 9 is placed above the movable contacts 5, 6 which are disposed in two upper and lower stages in the bottom portion of the accommodating portion 1*a*. The pressing portion 9*a* is projected from the front cutout 1*f* of the housing 1. The tip end side of the actuating portion 9*b* which is a free end side is placed so as to be directly opposed to a center portion (top portion) of the upper movable contact 5. The sliding portions 9*c* are slidably accommodated in right and left side portions of the accommodating portion 1*a*.

In the actuating portion 9*b*, the tip end side is wider than the root side which is the fixed end side (fulcrum side), a second inclined portion 9*d* which is formed by chamfering an upper edge portion on the tip end side is disposed in an upper portion of the tip end side of the actuating portion 9*b*, a third inclined portion 9*e* which is formed by largely (as compared with the second inclined portion 9*d*) chamfering a lower edge portion on the tip end side is disposed on a lower portion of the tip end side of the actuating portion 9*b*, and right and left end portions of the second inclined portion 9*d* are opposed to and butt against the first inclined portions 8*a* of the pair of right and left the guiding portions 8, respectively.

The sliding portions 9*c* have an L-like section shape in which an outer lower edge portion is squarely cut away.

In FIGS. 1, 4, 5, and 6, the reference numeral 10 denotes a second actuating member which is made of an insulating material such as a synthetic resin, and which has a peripheral portion 10*a* that is accommodated in a peripheral side portion of the accommodating portion 1*a*. The peripheral portion 10*a* is formed into a U-like shape, and configured by: a coupling plate 10*b* which extends along a rear sidewall of the housing 1, and which is a middle portion of the peripheral portion 10*a*; and right and left guide portions 10*c* in which the rear end sides are formed continuously with the both end portions of the coupling plate 10*b*, which forward extend along the right and left sidewalls of the housing 1, and which are side end portions of the peripheral portion 10*a*. The peripheral portion 10*a* is accommodated with being positioned and fixed to a peripheral portion of the accommodating portion 1*a* while the lower faces of the right and left guide portions 10*c* are buttingly supported by the inner bottom face 1*b* of the housing 1, the outer side faces of the right and left guide portions 10*c* are contacted with the inner faces of the right and left sidewalls of the housing 1, and the upper faces of the right and left guide portions 10*c* are pressed by the upper plate 7*a* of the cover 7. The right and left guide portions 10*c* of the peripheral portion 10*a* have an L-like section shape in which an inner lower edge portion is squarely cut away, and which is point-symmetric to the corresponding one of the right and left sliding portions 9*c*, and the upper horizontal portions of the right and left sliding portions 9*c* are superimposed on the lower horizontal portions of the right and left guide portions 10*c*, whereby the operating member 9 is supported by the right and left guide portions 10*c* of the peripheral portion 10*a* so as to be reciprocally movable only in the anteroposterior direction, while only movements in the anteroposterior direction of the right and left sliding portions 9*c* are allowed in such a manner that lateral movements of the right and left sliding portions 9*c* are restricted by the vertical portions of the right and left guide portions 10*c*, and vertical movements of the right and left sliding portions 9*c* are restricted by the lower horizontal portions of the right and left guide portions 10*c* and the upper plate 7*a* opposed thereto. The right and left guide portions 10*c* of the peripheral portion 10*a* close the opened upper faces of the upper-movable contact supporting recesses 1*c* and right and left bent portion accommodating portions 1*e* of the housing 1, to prevent the upper movable contact 5 through the leg portions 5*a* from rising, and prevent the lower movable contact 6 through the right and left bent portions 6*a* from rising.

The second actuating member 10 is projected from a middle portion of the coupling plate 10*b* which is laterally hung in the rear side of the accommodating portion 1*a*, to be opposed to the actuating portion 9*b*, so that the member is formed into a cantilever structure. Between the pair of right and left the guiding portions 8, the tip end side of the second actuating member 10 which is the free end side is placed so as to be directly opposed to the center portion (top portion) of the upper movable contact 5. In an upper portion of the tip end side of the second actuating member 10, a fourth inclined portion 10*d* which is formed by chamfering an upper edge portion on the tip end side is disposed, and, in a lower portion of the tip end side, a spherical projection 10*e* which is downward projected is disposed. The fourth inclined portion 10*d* is opposed to and butt against the third inclined portion 9*e* of the actuating portion 9*b* between the pair of right and left the guiding portions 8, and the projection 10*e* is opposed to and butt against the center portion (top portion) of the upper movable contact 5.

The coupling plate 10*b* which is formed in continuously with the root side of the second actuating member 10 that is the fixed end side (fulcrum side) is formed thinner than the right and left guide portions 10*c*, so as to be twistedly deformable in accordance with depressing of the tip end side of the second actuating member 10. In order to enable the third inclined portion 9*e* of the actuating portion 9*b* and the fourth inclined portion 10*d* of the second actuating member 10 to be in line contact with each other, the surface of one of the portions is formed as a flat face, and that of the other portion is formed as a convex curved face. In the embodiment, the surface of the fourth inclined portion 10*d* is formed as a convex curved face.

The push-button switch of the embodiment is assembled in the following manner. As shown in FIG. 4, the upper and lower movable contacts 5, 6 are placed in two upper and lower stages in the bottom portion of the accommodating portion 1*a* of the housing 1, and then the second actuating member 10 is accommodated together with the peripheral portion 10*a* in the upper portion of the accommodating portion 1*a*. Next, while the pressing portion 9*a* of the operating member 9 is fitted into the front cutout 1*f* of the housing 1, the actuating portion 9*b* and right and left sliding portions 9*c* of the operating member 9 are accommodated. In the next final step, the cover 7 is put on the housing 1 and attached thereto, and then the tip end sides of the grounding terminals 7*e* are bent to form the grounding soldering portions 7*g*, thereby completing the assembling process.

Next, the operation of the push-button switch of the embodiment will be described with reference to FIGS. 1, 7, and 8.

In the initial or preoperative state where the operating member 9 has not yet been operated, the upper and lower movable contacts 5, 6 are in the upward inflated initial state and separated from each other, and the center portion of the lower movable contact 6 is separated from and opposed to the second selection contact 4*a*. The operating member 9 is located at the initial position, and the actuating portion 9*b* is projected from the pressing portion 9*a*, and substantially horizontally supported in the accommodating portion 1*a*. Also the second actuating member 10 is located at the initial position, opposed to the actuating portion 9*b* of the operating member 9, and substantially horizontally supported in the accommodating portion 1*a*. The right and left end portions of the second inclined portion 9*d* of the actuating portion 9*b* are opposed to and butt against the first inclined portions 8*a* of the right and left the guiding portions 8. The third inclined portion 9*e* of the actuating portion 9*b* is opposed to and butts against the fourth inclined portion 10*d* of the second actuating member 10. The projection 10*e* of the second actuating member 10 is opposed to and butts against the center portion of the upper movable contact 5.

Figure 7:
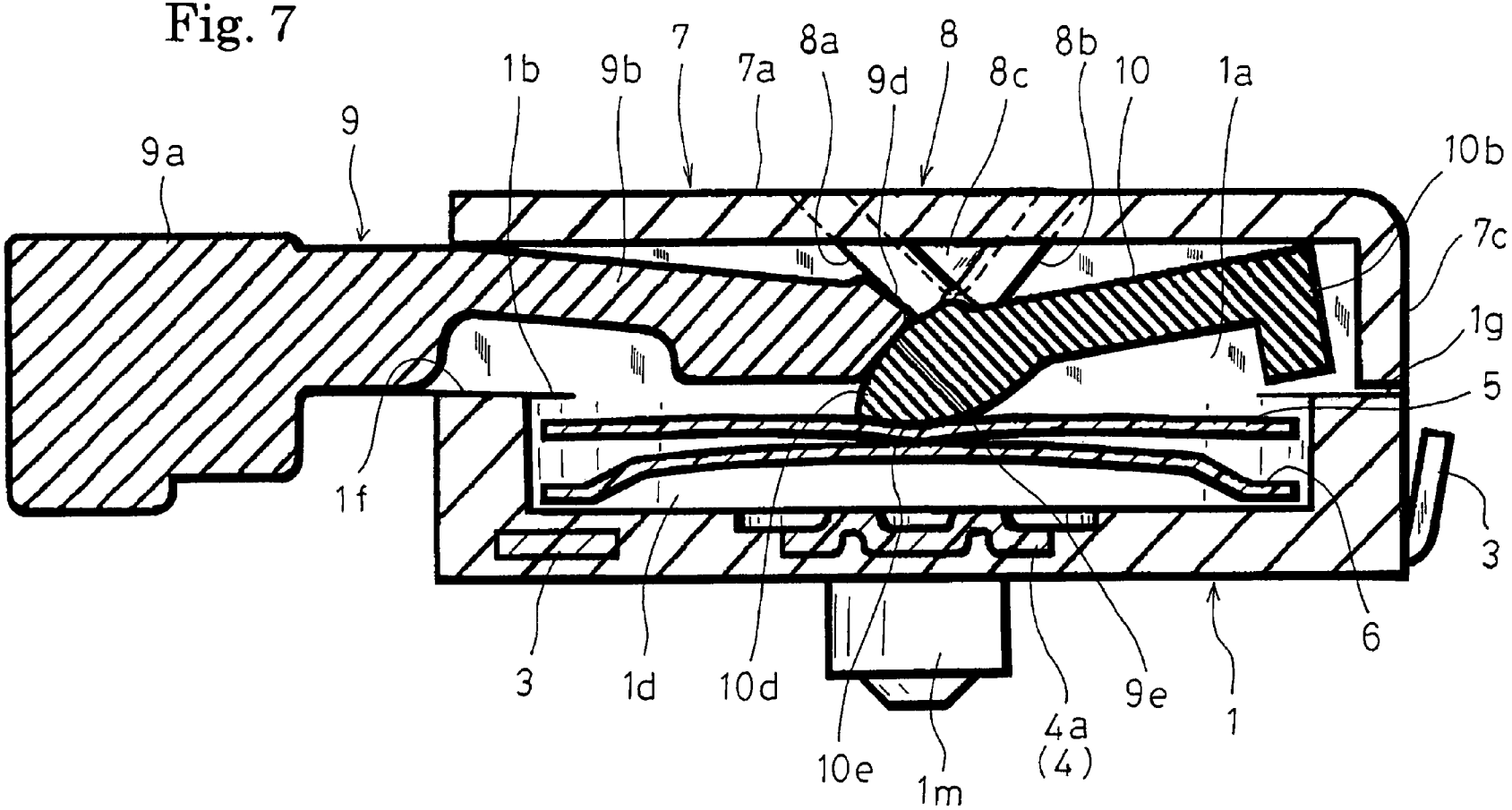
FIG. 7 is a section view showing an operation state of a first step of the push-button switch of the embodiment of the invention.

When the pressing portion 9*a* of the operating member 9 is forward pressed in the lateral direction in the initial state, as shown in FIG. 7, the whole operating member 9 is forward moved, and the right and left end portions of the second inclined portion 9*d* of the actuating portion 9*b* are slidingly moved on the first inclined portions 8*a* of the right and left the guiding portions 8 toward the lower ends of the inclinations, whereby the pressing of the operating member 9 in the lateral direction is converted to that in a downward perpendicular direction. As a result, the tip end side of the actuating portion 9*b* is depressed while involving flexural deformation of the actuating portion 9*b*. Since the fourth inclined portion 10*d* of the second actuating member 10 butts against the third inclined portion 9*e* of the actuating portion 9*b*, the third inclined portion 9*e* of the actuating portion 9*b* is slidingly moved on the fourth inclined portion 10*d* toward the upper end side of the inclination in accordance with the downward and forward movement of the tip end side of the actuating portion 9*b*, while depressing the fourth inclined portion 10*d* of the second actuating member 10, whereby the lateral pressing of the operating member 9 is converted to that in a downward perpendicular direction to be transmitted toward the tip end side of the second actuating member 10. Therefore, the tip end side of the second actuating member 10 is depressed by a depressing amount that is an addition of a drop amount of the tip end side of the actuating portion 9*b* and the depressing amount in which the lateral pressing component is converted to the downward perpendicular direction. As a result, the center portion of the upper movable contact 5 is depressed by the projection 10*e* in the lower portion of the tip end side of the second actuating member 10.

When the center portion of the upper movable contact 5 is depressed, the upper movable contact 5 is downward inverted to be contacted with the lower movable contact 6 which is on the lower side of the upper movable contact. Therefore, the common contact 2*a* and the first selection contact 3*a* are electrically conductively connected to each other through the upper and lower movable contacts 5, 6 to turn on the first-step switch. Namely, an operation sense and electric signal of the first step are output.

Figure 8:
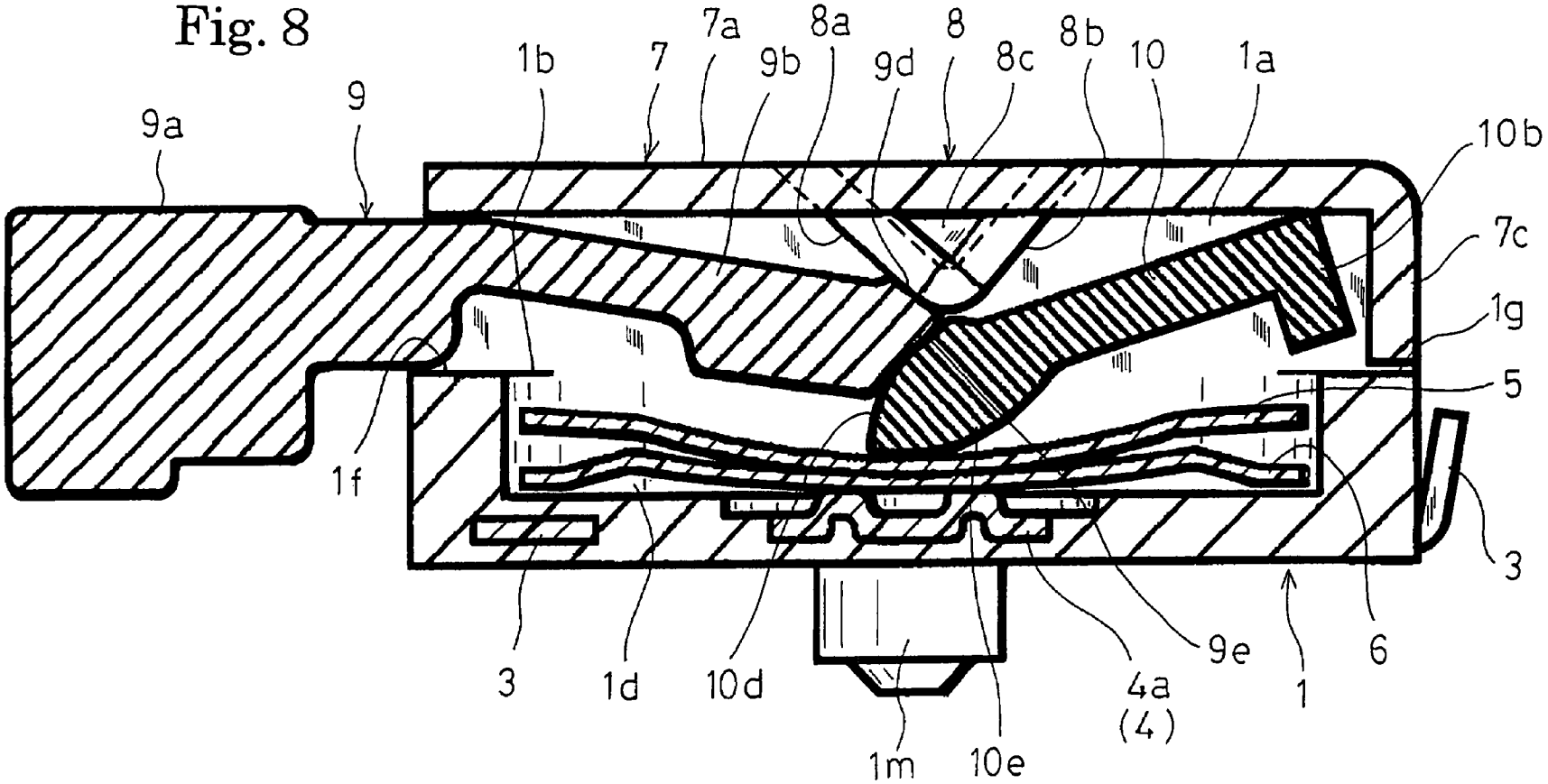
FIG. 8 is a section view showing an operation state of a second step of the push-button switch of the embodiment of the invention.
Figure 9:
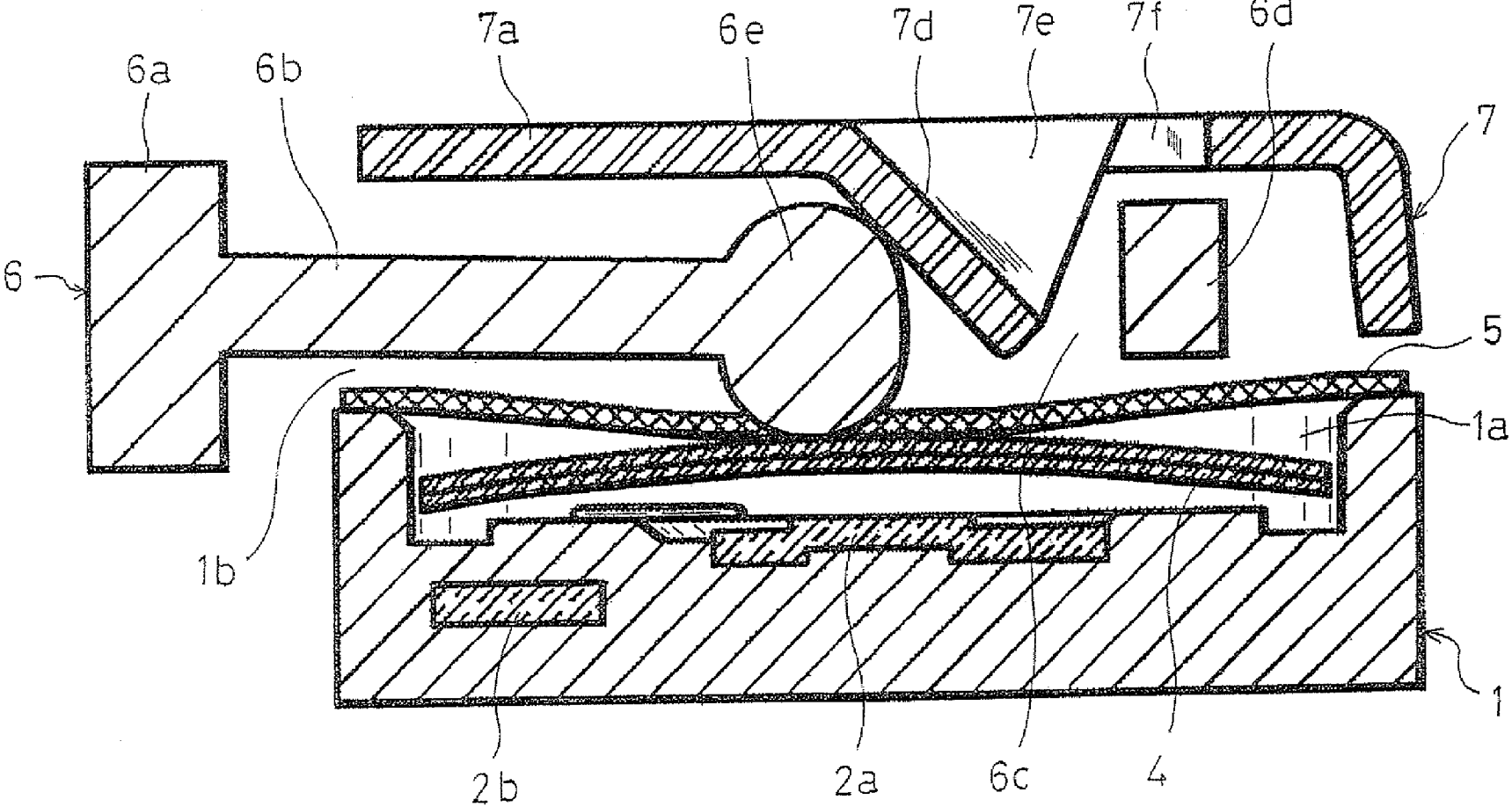
Fig. 9 PRIOR ART
FIG. 9 is a section view showing a conventional push-button switch.
Figure 1:
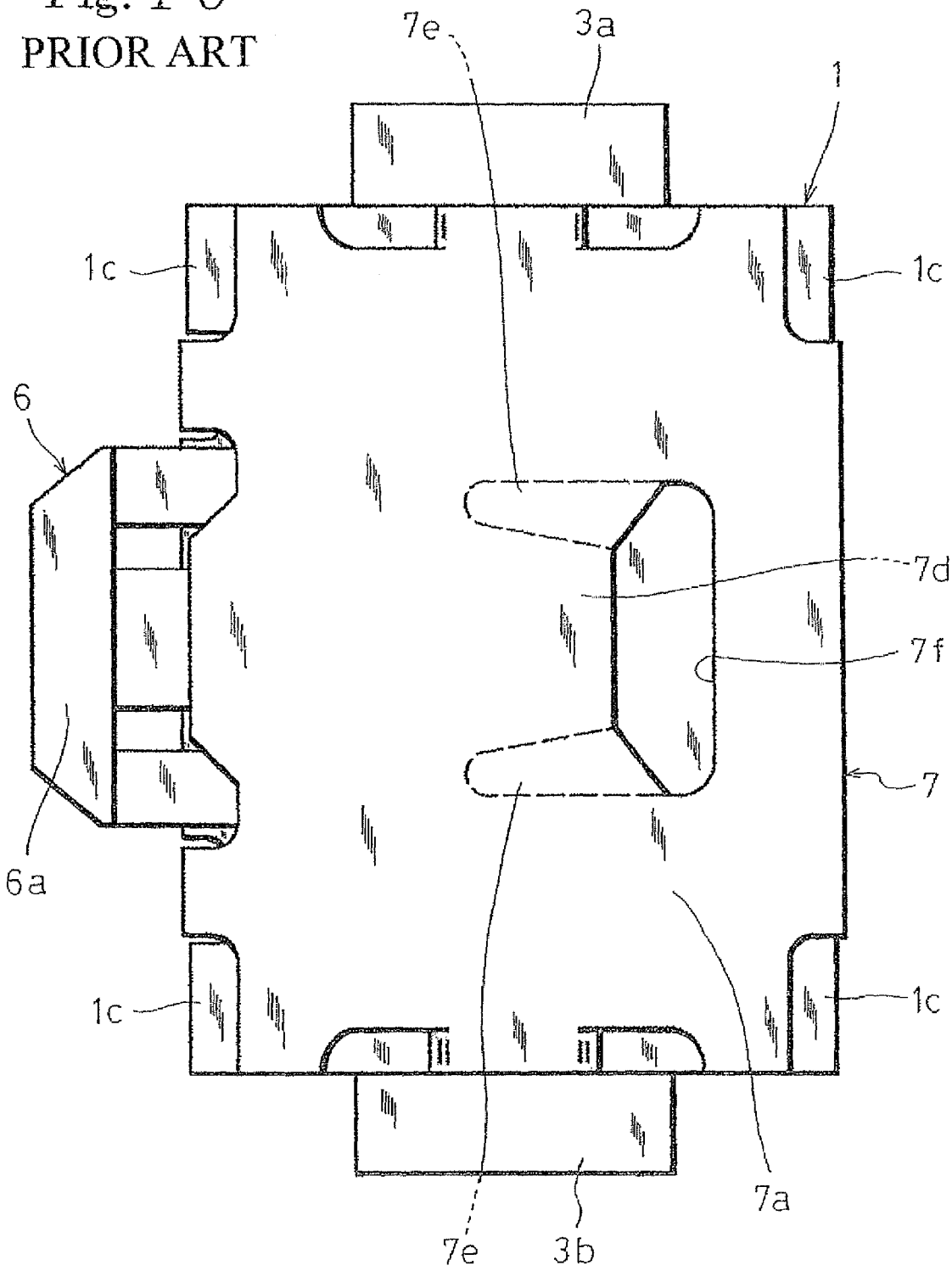
Fig. 1 0 PRIOR ART
Figure 1:
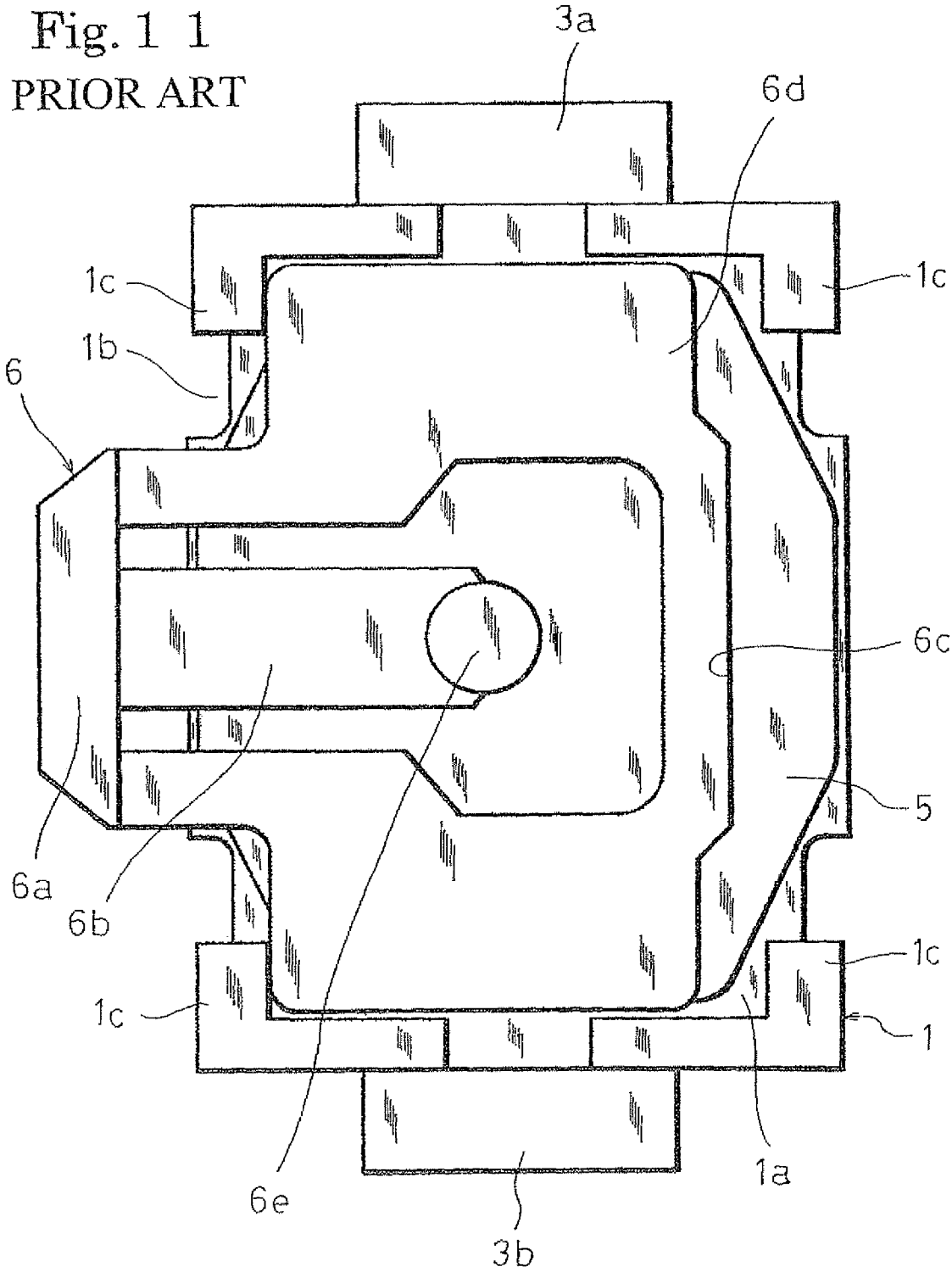
Fig. 1 1 PRIOR ART
Figure 12:
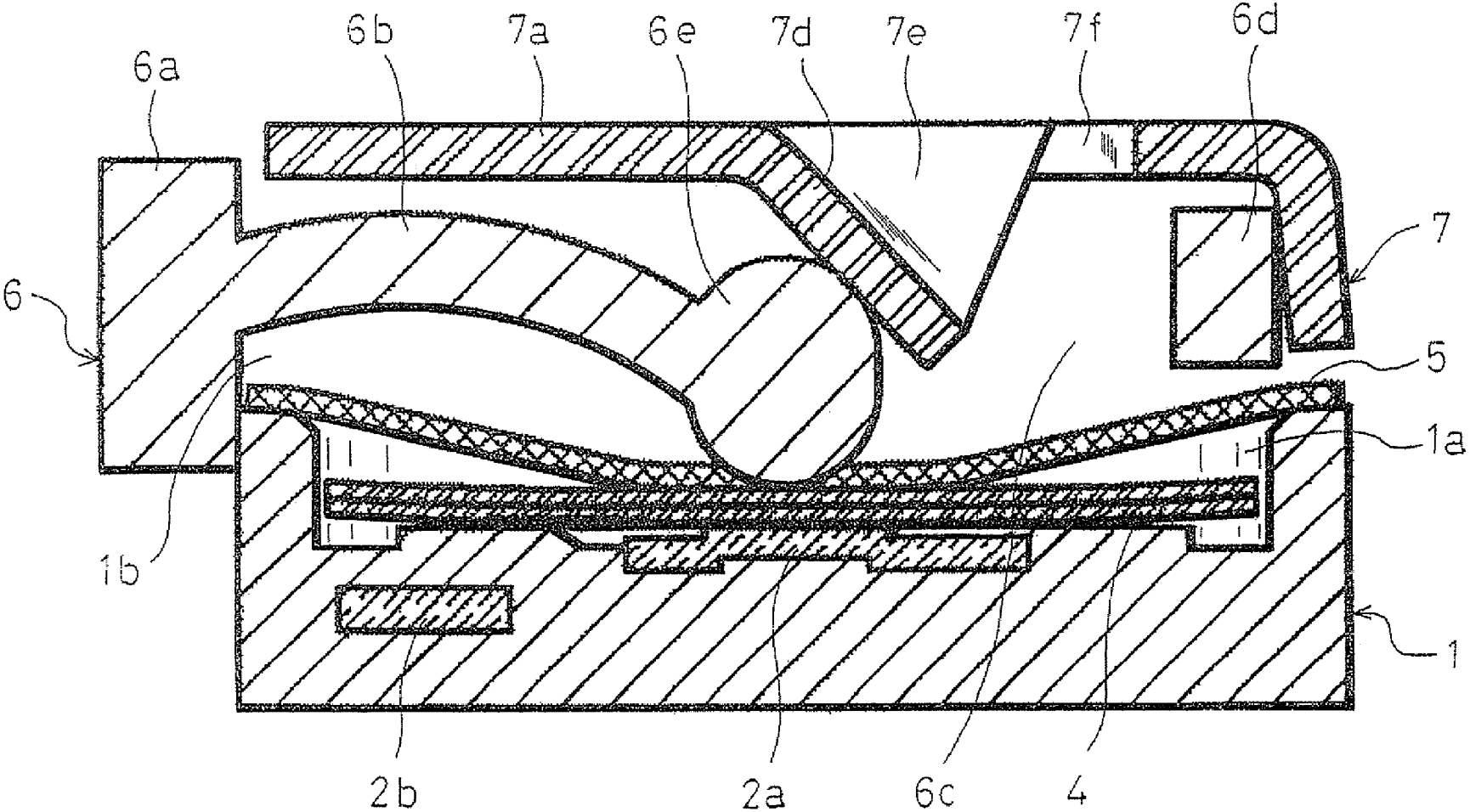
Fig. 12 PRIOR ART
FIG. 12 is a section view showing an operation state of the conventional push-button switch.

When the pressing portion 9*a* of the operating member 9 is further forward pressed in the lateral direction, as shown in FIG. 8, the whole operating member 9 is further forward moved, and the right and left end portions of the second inclined portion 9*d* of the actuating portion 9*b* are further slidingly moved on the first inclined portions 8*a* of the right and left the guiding portions 8 toward the lower ends of the inclinations, whereby the tip end side of the actuating portion 9*b* is further depressed while involving flexural deformation of the actuating portion 9*b*. In accordance with the downward and forward movement of the tip end side of the actuating portion 9*b*, the third inclined portion 9*e* of the actuating portion 9*b* is further slidingly moved on the fourth inclined portion 10*d* toward the upper end side of the inclination, while further depressing the fourth inclined portion 10*d* of the second actuating member 10, whereby the tip end side of the second actuating member 10 is depressed by a depressing amount that is an addition of a further drop amount of the tip end side of the actuating portion 9*b* and the further depressing amount in which the lateral pressing component is converted to the downward perpendicular direction. As a result, the center portion of the lower movable contact 6 is depressed together with that of the upper movable contact 5 by the projection 10*e* in the lower portion of the tip end side of the second actuating member 10.

When the center portion of the lower movable contact 6 is depressed, the lower movable contact 6 is downward inverted to be contacted with the second selection contact 4*a* which is on the lower side of the center portion. Therefore, the common contact 2*a* and the second selection contact 4*a* are electrically conductively connected to each other through the upper and lower movable contacts 5, 6 to turn on the second-step switch subsequent to the first-step switch. Namely, an operation sense and electric signal of the second step are output subsequent to the operation sense and electric signal of the first step are output.

During a period when the pressing portion 9*a* of the operating member 9 is pressed and the lower movable contact 6 is in contact with the second selection contact 4*a*, the ON states of the first- and second-step switches are maintained.

When, in this state where the first- and second-step switches are turned ON, the lateral pressing of the operating member 9 is released, the upper and lower movable contacts 5, 6 are upward inverted by their spring forces to return to their initial states, and also the actuating portion 9*b* of the operating member 9 and the second actuating member 10 are returned to their initial states by the respective elastic returning forces. In accordance with this, the operating member 9 is returned to its initial position, and to the initial state shown in FIG. 1 which is attained before the switch operation. In returning to the initial state, at the timing when the contact between the lower movable contact 6 and the second selection contact 4*a* is broken, the second-step switch is turned OFF, and, at the timing when the contact between the upper and lower movable contacts 5, 6 is broken, the first-step switch is turned OFF.

Although the preferred embodiment of the invention has been described, the invention is not restricted to this, and various modifications may be made without departing the spirit and scope of the invention.

What is claimed is:

1. A push-button switch in which said switch comprises: a housing having an accommodating portion; a stationary contact disposed in a bottom portion of said accommodating portion; a movable contact disposed above said stationary contact; an operating member which is slidably accommodated in said accommodating portion, and which has: a pressing portion that is outward projected from a side portion of said housing; and an actuating portion that has a cantilever structure, and that is projected from said pressing portion into said accommodating portion; and a cover which is configured by a metal plate, which is attached to an upper portion of said housing to cover said accommodating portion, and which has a guiding portion against which a tip end side of said actuating portion is buttable, and, when said pressing portion is pressed in a lateral direction, said tip end side of said actuating portion is caused to butt against said guiding portion to be guided toward said movable contact which is on a lower side, thereby contacting said movable contact with said stationary contact, wherein said switch further comprises: a second actuating member which has a peripheral portion that is positioned and fixed to be accommodated in a peripheral side portion of said accommodating portion, said peripheral portion of the second actuating member being formed continuously with a cantilever structure and projected into said accommodating portion to be opposed to said actuating portion; a pair of guiding portions which are disposed on both sides of a tip end side of said second actuating member; first inclined portions which are disposed on said guiding portions, respectively, and which are inclined with respect to a pressing direction of said pressing portion; a second inclined portion which is disposed on an upper portion of said tip end side of said actuating portion, and which is opposed to said first inclined portions; a third inclined portion which is disposed on a lower portion of said tip end side of said actuating portion, and which extends in a direction intersecting with said first and second inclined portions that are opposed to each other; a fourth inclined portion which is disposed on an upper portion of said tip end side of said second actuating member, and which is opposed to said third inclined portion; and a projection which is disposed on a lower portion to said tip end side of said second actuating member, and which is opposed to said movable contact, and, when said pressing portion is pressed in the lateral direction, while said tip end side of said actuating portion causes said second inclined portion to butt against said first inclined portion and is guided toward said movable contact which is on the lower side, said tip end side of said actuating member causes said second inclined portion to butt against said third inclined portion to displace said tip end side of said second actuating member toward said movable contact which is on the lower side, and said projection to butt against said movable contact to depress said movable contact, whereby said movable contact is contacted with said stationary contact, wherein a peripheral portion of said second actuating member is formed into a U-like shape which surrounds a basal end side of said second actuating member and said both sides of said tip end portion of said second actuating member, a middle portion of said peripheral portion from which said second actuating member is projected is formed to be thinner than both end portions, and, while said middle portion is twistingly deformed, said tip end side of said second actuating member is displaced toward said movable contact which is on the lower side.

2. A push-button switch according to claim 1, wherein a surface of one of said third and fourth inclined portions is formed as a flat face, and a surface of another portion is formed as a convex curved face.

3. A push-button switch according to claim 1, wherein a surface of said projection is configured by a part of a convex spherical face.

4. A push-button switch according to claim 1, wherein said movable contact is configured by an invertible dome-like metal plate, and said projection of said second actuating member is opposed to a center portion of said movable contact.

5. A push-button switch according to claim 1, wherein said movable contact is configured by an invertible dome-like metal plate, wherein said movable contact is disposed in two upper and lower stages, wherein different first, second, and third stationary contacts are disposed at three places of a bottom side of a peripheral portion of an upper movable contact, and bottom sides of peripheral and center portions of a lower movable contact, wherein said upper movable contact is always contacted with said first stationary contact and said lower movable contact is always contacted with said second stationary contact, wherein when said upper movable contact is depressed, said upper movable contact is downward inverted to be contacted with said lower movable contact, and wherein when said upper movable contact is further depressed, said lower movable contact is depressed to be inverted to be contacted with said third stationary terminal.

6. A push-button switch according to claim 1, wherein said movable contact is configured by an invertible dome-like metal plate, wherein said movable contact is disposed in two upper and lower stages, wherein different first, second, and third stationary contacts are disposed at three places of a bottom side of a peripheral portion of an upper movable contact, and bottom sides of peripheral and center portions of a lower movable contact, wherein said upper movable contact is always contacted with said first stationary contact and said lower movable contact is always contacted with said second stationary contact, wherein when said upper movable contact is depressed, said upper movable contact is downward inverted to be contacted with said lower movable contact, wherein when said upper movable contact is further depressed, said lower movable contact is depressed to be inverted to be contacted with said third stationary terminal, and wherein said lower movable contact comprises a bent portion which is pressed by a part of said peripheral portion of said second actuating member, to prevent said lower movable contact from rising.

7. A push-button switch 1 in which said switch comprises: a housing having an accommodating portion; a stationary contact disposed in a bottom portion of said accommodating portion; a movable contact disposed above said stationary contact; an operating member which is slidably accommodated in said accommodating portion, and which has: a pressing portion that is outward projected from a side portion of said housing; and an actuating portion that has a cantilever structure, and that is projected from said pressing portion into said accommodating portion; and a cover which is configured by a metal plate, which is attached to an upper portion of said housing to cover said accommodating portion, and which has a guiding portion against which a tip end side of said actuating portion is buttable, and, when said pressing portion is pressed in a lateral direction, said tip end side of said actuating portion is caused to butt against said guiding portion to be guided toward said movable contact which is on a lower side, thereby contacting said movable contact with said stationary contact, wherein said switch further comprises: a second actuating member which has a peripheral portion that is positioned and fixed to be accommodated in a peripheral side portion of said accommodating portion, said peripheral portion of the second actuating member being formed continuously with a cantilever structure and projected into said accommodating portion to be opposed to said actuating portion; a pair of guiding portions which are disposed on both sides of a tip end side of said second actuating member; first inclined portions which are disposed on said guiding portions, respectively, and which are inclined with respect to a pressing direction of said pressing portion; a second inclined portion which is disposed on an upper portion of said tip end side of said actuating portion, and which is opposed to said first inclined portions; a third inclined portion which is disposed on a lower portion of said tip end side of said actuating portion, and which extends in a direction intersecting with said first and second inclined portions that are opposed to each other; a fourth inclined portion which is disposed on an upper portion of said tip end side of said second actuating member, and which is opposed to said third inclined portion; and a projection which is disposed on a lower portion to said tip end side of said second actuating member, and which is opposed to said movable contact, and, when said pressing portion is pressed in the lateral direction, while said tip end side of said actuating portion causes said second inclined portion to butt against said first inclined portion and is guided toward said movable contact which is on the lower side, said tip end side of said actuating member causes said second inclined portion to butt against said third inclined portion to displace said tip end side of said second actuating member toward said movable contact which is on the lower side, and said projection to butt against said movable contact to depress said movable contact, whereby said movable contact is contacted with said stationary contact, wherein said operating member comprises, on both sides of said actuating portion, a pair of sliding portions which are projected from said pressing portion to said peripheral side portion of said accommodating portion, a peripheral portion of said second actuating member is formed into a U-like shape which surrounds a basal end side and both sides of said second actuating member, and guide portions which slidably support said sliding portions are disposed in both end portions of said peripheral portion of said second actuating member.

8. A push-button switch according to claim 7, wherein a surface of one of said third and fourth inclined portions is formed as a flat face, and a surface of another portion is formed as a convex curved face.

9. A push-button switch according to claim 7, wherein a surface of said projection is configured by a part of a convex spherical face.

10. A push-button switch according to claim 7, wherein said movable contact is configured by an invertible dome-like metal plate, and said projection of said second actuating member is opposed to a center portion of said movable contact.

11. A push-button switch according to claim 7, wherein said movable contact is configured by an invertible dome-like metal plate, wherein said movable contact is disposed in two upper and lower stages, wherein different first, second, and third stationary contacts are disposed at three places of a bottom side of a peripheral portion of an upper movable contact, and bottom sides of peripheral and center portions of a lower movable contact, wherein said upper movable contact is always contacted with said first stationary contact and said lower movable contact is always contacted with said second stationary contact, wherein when said upper movable contact is depressed, said upper movable contact is downward inverted to be contacted with said lower movable contact, and wherein when said upper movable contact is further depressed, said lower movable contact is depressed to be inverted to be contacted with said third stationary terminal.

12. A push-button switch according to claim 7, wherein said movable contact is configured by an invertible dome-like metal plate, wherein said movable contact is disposed in two upper and lower stages, wherein different first, second, and third stationary contacts are disposed at three places of a bottom side of a peripheral portion of an upper movable contact, and bottom sides of peripheral and center portions of a lower movable contact, wherein said upper movable contact is always contacted with said first stationary contact and said lower movable contact is always contacted with said second stationary contact, wherein when said upper movable contact is depressed, said upper movable contact is downward inverted to be contacted with said lower movable contact, wherein when said upper movable contact is further depressed, said lower movable contact is depressed to be inverted to be contacted with said third stationary terminal, and wherein said lower movable contact comprises a bent portion which is pressed by a part of said peripheral portion of said second actuating member, to prevent said lower movable contact from rising.

13. A push-button switch in which said switch comprises: a housing having an accommodating portion; a stationary contact disposed in a bottom portion of said accommodating portion; a movable contact disposed above said stationary contact; an operating member which is slidably accommodated in said accommodating portion, and which has: a pressing portion that is outward projected from a side portion of said housing; and an actuating portion that has a cantilever structure, and that is projected from said pressing portion into said accommodating portion; and a cover which is configured by a metal plate, which is attached to an upper portion of said housing to cover said accommodating portion, and which has a guiding portion against which a tip end side of said actuating portion is buttable, and, when said pressing portion is pressed in a lateral direction, said tip end side of said actuating portion is caused to butt against said guiding portion to be guided toward said movable contact which is on a lower side, thereby contacting said movable contact with said stationary contact, wherein said switch further comprises: a second actuating member which has a peripheral portion that is positioned and fixed to be accommodated in a peripheral side portion of said accommodating portion, said peripheral portion of the second actuating member being formed continuously with a cantilever structure and projected into said accommodating portion to be opposed to said actuating portion; a pair of guiding portions which are disposed on both sides of a tip end side of said second actuating member; first inclined portions which are disposed on said guiding portions, respectively, and which are inclined with respect to a pressing direction of said pressing portion; a second inclined portion which is disposed on an upper portion of said tip end side of said actuating portion, and which is opposed to said first inclined portions; a third inclined portion which is disposed on a lower portion of said tip end side of said actuating portion, and which extends in a direction intersecting with said first and second inclined portions that are opposed to each other; a fourth inclined portion which is disposed on an upper portion of said tip end side of said second actuating member, and which is opposed to said third inclined portion; and a projection which is disposed on a lower portion to said tip end side of said second actuating member, and which is opposed to said movable contact, and, when said pressing portion is pressed in the lateral direction, while said tip end side of said actuating portion causes said second inclined portion to butt against said first inclined portion and is guided toward said movable contact which is on the lower side, said tip end side of said actuating member causes said second inclined portion to butt against said third inclined portion to displace said tip end side of said second actuating member toward said movable contact which is on the lower side, and said projection to butt against said movable contact to depress said movable contact, whereby said movable contact is contacted with said stationary contact, wherein said cover is attached to an upper portion of said housing, and comprises an upper plate which is formed in a flat plate-like shape so as to cover said accommodating portion, each of said guiding portions is formed by a pressing process in which said upper plate is partly formed into a V-like three-dimensional shape where an outer face is concave, an inner face is convex, and both ends are closed, and said first inclined portion is formed by one inclined linear portion of the V-like shape.

14. A push-button switch according to claim 13, wherein a surface of one of said third and fourth inclined portions is formed as a flat face, and a surface of another portion is formed as a convex curved face.

15. A push-button switch according to claim 13, wherein a surface of said projection is configured by a part of a convex spherical face.

16. A push-button switch according to claim 13, wherein said movable contact is configured by an invertible dome-like metal plate, and said projection of said second actuating member is opposed to a center portion of said movable contact.

17. A push-button switch according to claim 13, wherein said movable contact is configured by an invertible dome-like metal plate, wherein said movable contact is disposed in two upper and lower stages, wherein different first, second, and third stationary contacts are disposed at three places of a bottom side of a peripheral portion of an upper movable contact, and bottom sides of peripheral and center portions of a lower movable contact, wherein said upper movable contact is always contacted with said first stationary contact and said lower movable contact is always contacted with said second stationary contact, wherein when said upper movable contact is depressed, said upper movable contact is downward inverted to be contacted with said lower movable contact, and wherein, when said upper movable contact is further depressed, said lower movable contact is depressed to be inverted to be contacted with said third stationary terminal.

18. A push-button switch according to claim 13, wherein said movable contact is configured by an invertible dome-like metal plate, wherein said movable contact is disposed in two upper and lower stages, wherein different first, second, and third stationary contacts are disposed at three places of a bottom side of a peripheral portion of an upper movable contact, and bottom sides of peripheral and center portions of a lower movable contact, wherein said upper movable contact is always contacted with said first stationary contact and said lower movable contact is always contacted with said second stationary contact, wherein when said upper movable contact is depressed, said upper movable contact is downward inverted to be contacted with said lower movable contact, wherein when said upper movable contact is further depressed, said lower movable contact is depressed to be inverted to be contacted with said third stationary terminal, and wherein said lower movable contact comprises a bent portion which is pressed by a part of said peripheral portion of said second actuating member, to prevent said lower movable contact from rising.

* * * * *

UNITED STATES PATENT AND TRADEMARK OFFICE

CERTIFICATE OF CORRECTION

PATENT NO. : 7,964,815 B2
APPLICATION NO. : 12/216976
DATED : June 21, 2011
INVENTOR(S) : Makoto Asada It is certified that error appears in the above-identified patent and that said Letters Patent is hereby corrected as shown below:

In claim 7, col. 14, line 53, "1" should be deleted

Signed and Sealed this
Thirteenth Day of March, 2012

David J. Kappos

David J. Kappos
*Director of the United States Patent and Trademark Office*